US005927280A

United States Patent [19]

Miyake

[11] Patent Number: 5,927,280

[45] Date of Patent: Jul. 27, 1999

[54] MASK

[75] Inventor: Kaoru Miyake, Shizuoka, Japan

[73] Assignee: San-M Package Co., Ltd., Shizuoka, Japan

[21] Appl. No.: 08/936,837

[22] Filed: Sep. 25, 1997

[30] Foreign Application Priority Data

Mar. 17, 1997 [JP] Japan ..... 9-062846
Jul. 31, 1997 [JP] Japan ..... 9-206133

[51] Int. Cl.[6] ..... A61F 11/00

[52] U.S. Cl. ..... 128/857; 128/206.12; 128/206.13; 2/9

[58] Field of Search ..... 128/846, 857, 128/859, 206.12, 206.13, 206.19; 2/9, 10, 11, 12

[56] References Cited

U.S. PATENT DOCUMENTS

| | | | |
|---|---|---|---|
| 2,458,580 | 1/1949 | Fisketti | 128/206.13 |
| 2,494,406 | 1/1950 | Reitano | 128/206.13 |
| 4,300,549 | 11/1981 | Parker | 128/206.12 |
| 4,323,063 | 4/1982 | Fisichella | 128/206.12 |
| 4,662,005 | 5/1987 | Grier-Idris | 2/9 |
| 4,966,140 | 10/1990 | Herzberg | 2/9 |

*Primary Examiner*—Michael A. Brown
*Attorney, Agent, or Firm*—Kanesaka & Takeuchi

[57] ABSTRACT

The present invention is to provide a mask capable of improving the stiffness. The mask includes a rectangular mask main body of a ventilating material, such as paper, fabric, and non-woven fabric, having folded portions folded in the direction parallel to the longer sides of the mask main body, with the both end portions of the folded portions on the shorter sides of the mask main body being bound by welding, adhering or stitching, wherein a longitudinal elastic member is provided along the longitudinal direction parallel to the longer sides of the mask main body, with the both end portions of the longitudinal elastic member being arranged on the shorter sides of the mask main body and integrated with the shorter ends of the mask main body by welding, adhering, or stitching.

7 Claims, 10 Drawing Sheets

MASK

BACKGROUND OF THE INVENTION

1. Field of the Invention

The present invention relates to a mask as a hygienic material used on a face, covering the mouth and the nose, in particular, to a mask used in an operation room of a hospital or in a clean room of a semiconductor manufacturing plant.

2. Description of the Related Art

In a surgical operation room or in a clean room, contamination or fouling of the indoor air by the germ or dust is prevented by the use of a facial mask. Since the facial mask needs to have substantially the same shape as the facial contour around the mouth and the nose in order to effectively shield between the inner side and the outer side of the mask, various kinds of masks are on market, including the folded type comprising a fabric partially folded with the both edges fixed, and the three-dimensionally molded type having a preliminarily three-dimensional shape without deformation.

The folded type comprises a single rectangular fabric partially folded with the both edges fixed so that the mask main body portion forms a substantially three-dimensional convex shape by expanding the folded part. That is, although it is an ordinary facial mask with a two-dimensional shape, it can have a three-dimensional shape by expanding the folded part in use.

However, in addition to the inherent difficulty in breathing by having the mouth and the nose covered by a mask, since the material of the mask comprises a fine mesh as well as the rear side of the mask main body comes in direct contact with the mouth, the air-flow area tends to be narrow. As a consequence, the mask fabric slides whenever the user breathes normally or talks with the other staff members, resulting in causing further difficulty in breathing.

On the other hand, the three-dimensionally molded type can be used as it is, without deformation since the shape of the main body portion is formed three-dimensionally in the manufacturing process, and thus it is handy.

However, the need of the manufacturing equipment for molding integrally and the large-scale manufacturing process pushes up the manufacturing cost. Besides, storage or transportation of many facial masks results in generating dead space.

SUMMARY OF THE INVENTION

In order to solve the above-mentioned problems, an object of the present invention is to provide a mask used on a face, capable of ensuring a space between the mask main body portion and the user's face for breathing as well as handling convenience in piling up in a large quantity during the conveyance or storage without generating dead space.

Another object of the present invention is to provide a mask used on a face, capable of achieving the abovementioned object even with a simple configuration.

Yet another object of the present invention is to provide a mask used on a face, without the risk of contacting the rear side of the mask main body with the user's mouth even during the inhalation.

Yet another object of the present invention is to provide a mask used on a face, capable of achieving the above-mentioned objects without requiring much labor in expanding the folded portions.

In order to achieve the above-mentioned objects, a mask according to a first aspect comprises a rectangular mask main body of a ventilating material, such as paper, fabric, and non-woven fabric, having folded portions folded in the direction parallel to the longer sides of the mask main body, with the both end portions of the folded portions on the shorter sides of the mask main body being bound by welding, adhering or stitching, wherein a longitudinal elastic member is provided along the longitudinal direction parallel to the longer sides of the mask main body, with the both end portions of the longitudinal elastic member being arranged on the shorter sides of the mask main body and integrated with the shorter ends of the mask main body by welding, adhering, or stitching.

A mask according to a second aspect comprises the mask according to the first aspect, wherein the longitudinal elastic member is arranged on the rear side of the mask main body.

A mask according to a third aspect comprises the mask according to the first aspect, wherein the rectangular mask main body comprises a rectangular rear side member of a ventilating material, such as paper, fabric, and non-woven fabric, facing at least to the nose and the mouth, and a rectangular front side member of a ventilating material, such as paper, fabric, and non-woven fabric, arranged opposing to the rear side member, and the longitudinal elastic member is stored in the rectangular mask main body.

A mask according to a fourth aspect comprises the mask according to the first aspect, wherein the rectangular mask main body comprises a rectangular front side member of a ventilating material, such as paper, fabric, and non-woven fabric, a rectangular middle member of a ventilating material, such as paper, fabric, and non-woven fabric, and a rear side member of a ventilating material, such as paper, fabric, and non-woven fabric facing the nose and the mouth, successively laminated from the front to the rear side, wherein the longitudinal elastic member is arranged between the rectangular middle member and the rectangular rear side member, with the air-flow resistance of the rectangular rear side member being smaller than the air-flow resistance of the middle member.

A mask according to a fifth aspect comprises the mask according to the first aspect, wherein the rectangular mask main body comprises a rectangular front side member of a ventilating material, such as paper, fabric, and non-woven fabric, a rectangular middle member of a ventilating material, such as paper, fabric, and non-woven fabric, and a rear side member of a ventilating material, such as paper, fabric, and non-woven fabric facing to the nose and the mouth, successively laminated from the front to the rear side, wherein the longitudinal elastic member is arranged between the rectangular middle member and the rectangular rear side member, with the longitudinal elastic member and the rectangular rear side member integrated by welding, adhering, or stitching.

A mask according to a sixth aspect comprises the mask according to the first aspect, wherein the rectangular mask main body comprises at least a rear side member facing to the nose and the mouth and a front side member arranged on the opposite side of the rear side member, with the longitudinal elastic member stored in the rectangular mask main body, where the laminated rear side member and front side member are integrated by welding, adhering or stitching in the periphery with the both end portions of the longitudinal elastic member being bound by integrating the rear side member and the front side member by welding, adhering or stitching at the time of integrating the shorter ends of the rear side member and the front side member by welding, adhering or stitching.

A mask according to a seventh aspect comprises the mask according to the first aspect, wherein the both end portions of the longitudinal elastic member are arranged at substantially the center part of the both shorter sides of the mask main body.

DESCRIPTION OF THE PREFERRED EMBODIMENT

A first embodiment of the present invention will be described with reference to the accompanied drawings.

Figure 1A:
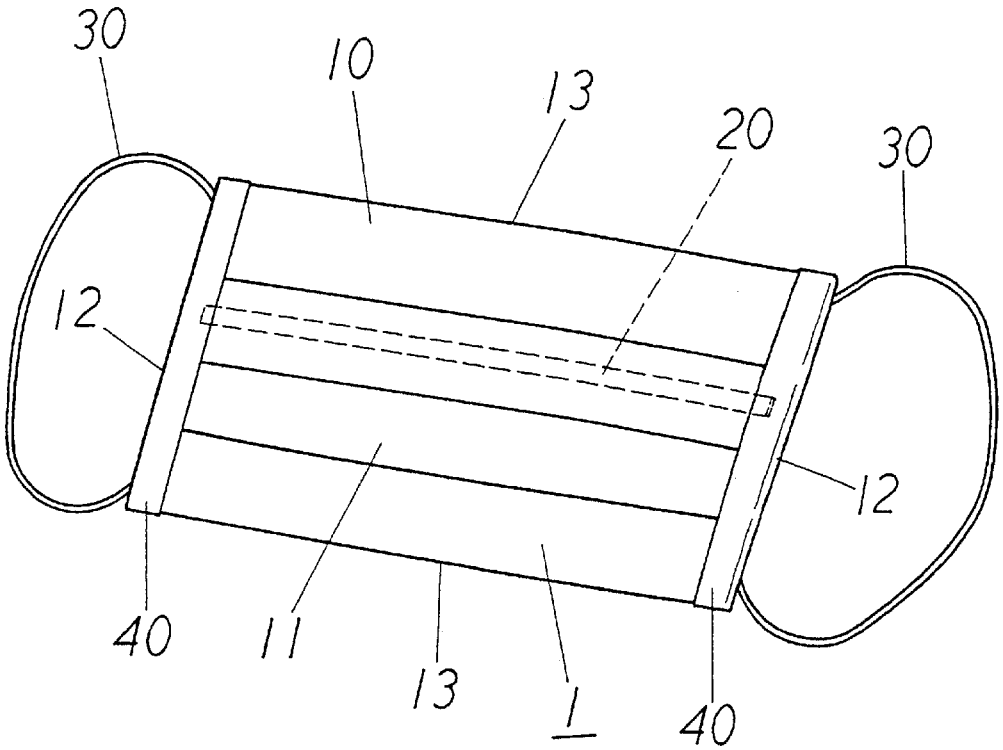
FIG. 1*a* is a perspective view showing the entire configuration of one embodiment of the mask of the present invention.

The facial mask has the entire configuration as shown in FIG. 1*a*, comprising a mask main body 10, an elastic member, such as a plastic thin plate 20, rubber bands 30, and side tapes 40.

The mask main body 10 comprises a rectangular high density mesh fabric with the middle part partially folded and fixed by the side tapes 40 along the shorter sides 12 including the folded portions 11.

Figure 1B:
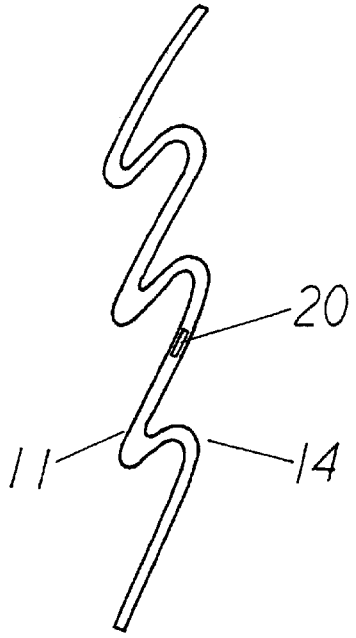
FIG. 1*b* is a cross-sectional view of the mask taken vertically with respect to FIG. 1*a*.
Figure 2A:
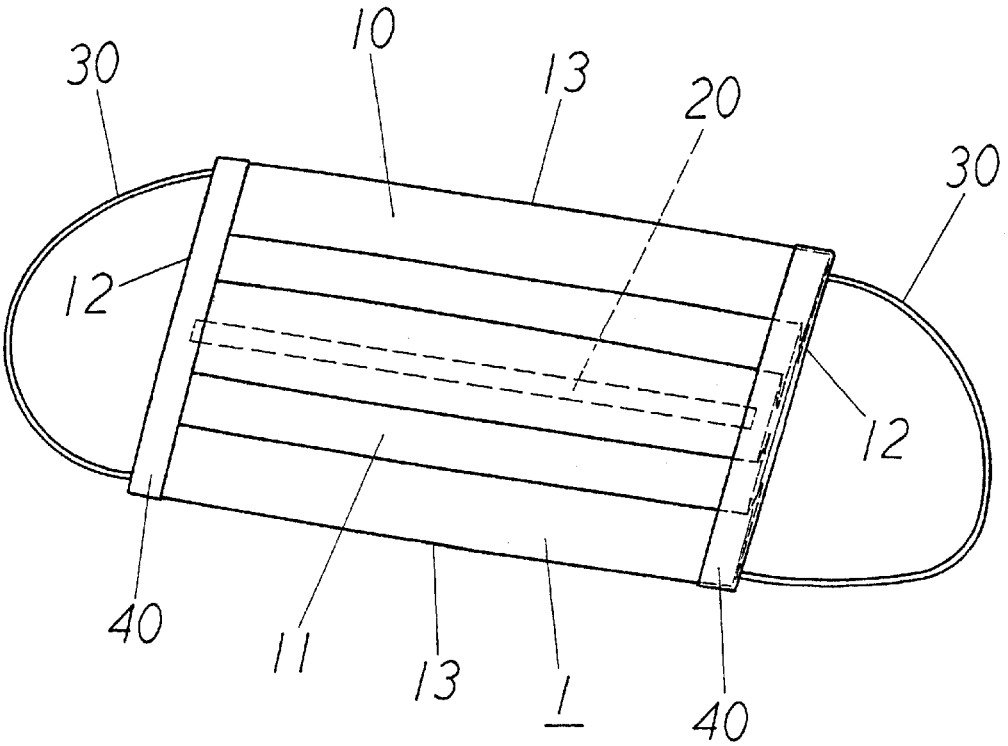
FIG. 2*a* is a perspective view showing the entire configuration of a modified embodiment of the mask of the present invention with a different folding manner.
Figure 2B:
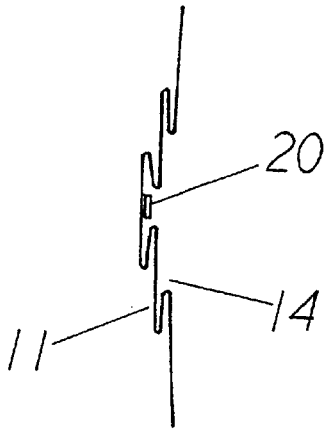
FIG. 2*b* is a cross-sectional view of the mask of FIG. 2*a*.

A cross-sectional view of the mask main body 10 is shown in FIG. 1*b*. The folded mask main body 10 has a plurality of darts (folded portions) 11. In this embodiment, the main body 10 is folded successively in one direction, but a different folding manner can be optionally adopted, such as the one shown in FIG. 2.

As shown in FIG. 1*a*, since the both end portions (shorter ends) 12 of the folded mask main body 10 are fixed, the folded portions 11 cannot expand thereat, but can be expanded at the other parts except the both end portions 12.

The rubber bands 30, which are attached to the shorter ends 12 of the folded mask main body 10, are to be hooked on the ears for wearing the mask 1. In this case, the folded portions 11 of the mask main body 10 can be expanded in the vertical direction. As another embodiment, the rubber bands 30 can be attached to the longer sides 13. In this case, the rubber bands 30 can be attached on the head with the mask main body 10 vertically expanded.

As shown in FIG. 1*b*, the mask main body 10 is provided with the plastic thin plate 20 along the folding lines. The plastic thin plate 20 is a narrow flat plate interposed in the fabrics comprising the mask main body 10 and stored inside thereof. The cross-section of the plastic thin plate 20 has a rectangular shape, with the longer sides being contacted with the fabrics comprising the mask main body 10.

In order to maintain a straight shape, the plastic thin plate 20 is attached (fixed) integrally to the mask main body 10 at the both ends. As to the position to be fixed, it is possible either to attach (fix) entirely, or partially, for example, at substantially the center of the plastic thin plate 20 to the rear side of the mask main body 14. In this case, since the plastic thin plate 20 is attached at the center portion only with the rear side, the attached portion cannot be observed so that the appearance is not ruined. The plastic thin plate 20 not in use has a straight shape and the mask main body 10 has a substantially flat shape.

Figure 3:
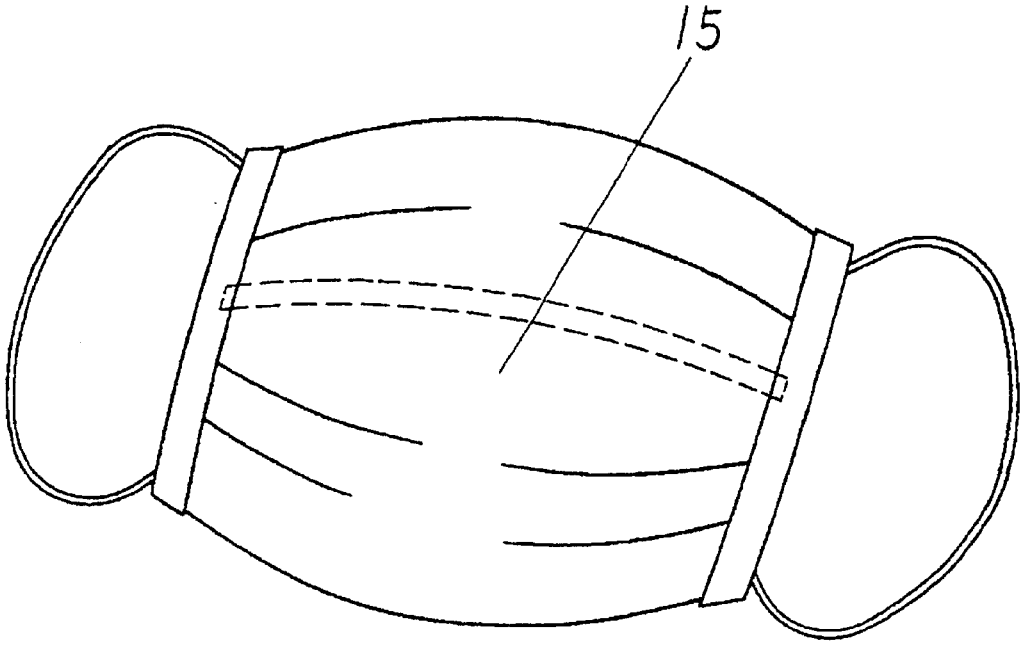
FIG. 3 is a perspective view of the mask of FIG. 1 with the mask main body expanded.

The mask main body 10 has a substantially convex shape with the middle part of the folded portions 11 being expanded as shown in FIG. 3. At the time, this plastic thin plate 20 has an arch-like shape so as to prevent deformation of the substantially convex shape portion (substantially cup-like portion) 15 of the mask main body 10. Since the plastic thin plate 20 is attached on the rear side 14 of the mask main body, the substantially convex shape 15 of the rear side 14 of the mask main body can be maintained even during inhalation so as to prevent disturbance of breath caused by the mask main body covering the mouth and the nose.

The mask main body can regain the substantially flat shape from the substantially convex shape by folding the mask main body 10 along the folding lines.

Figure 4:
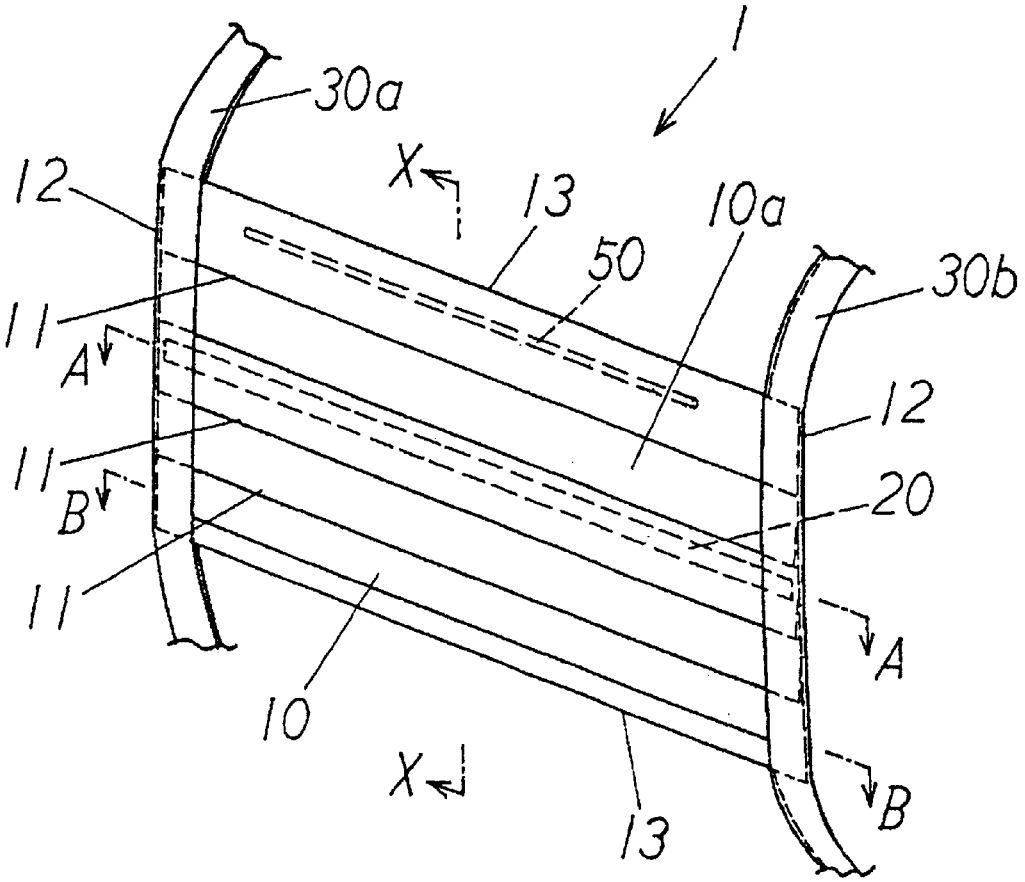
FIG. 4 is a schematic perspective view of another embodiment of the mask of the present invention.

FIGS. 4 to 11 show another embodiment of the present invention. In FIG. 4, the numeral 10 denotes a rectangular mask main body comprising a ventilating material, such as paper, fabric, or non-woven fabric. The rectangular mask main body 10 has a plurality of folding lines 11 parallel to the longer sides 13. The mask 1 has both end portions of the folding lines 11 bound at the both shorter side portions 12 (both end portions) of the rectangular mask main body 10 by welding, adhering or stitching.

Figure 6:
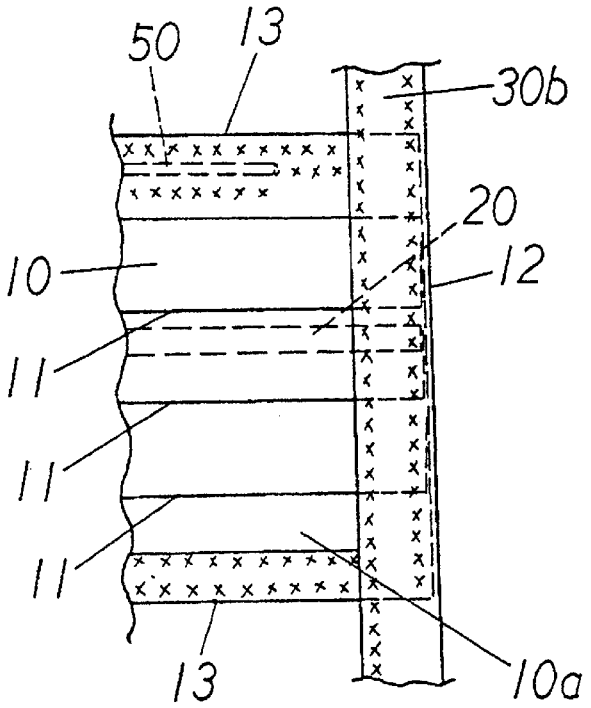
FIG. 6 is a partially enlarged schematic plan view of FIG. 4.
Figure 10:
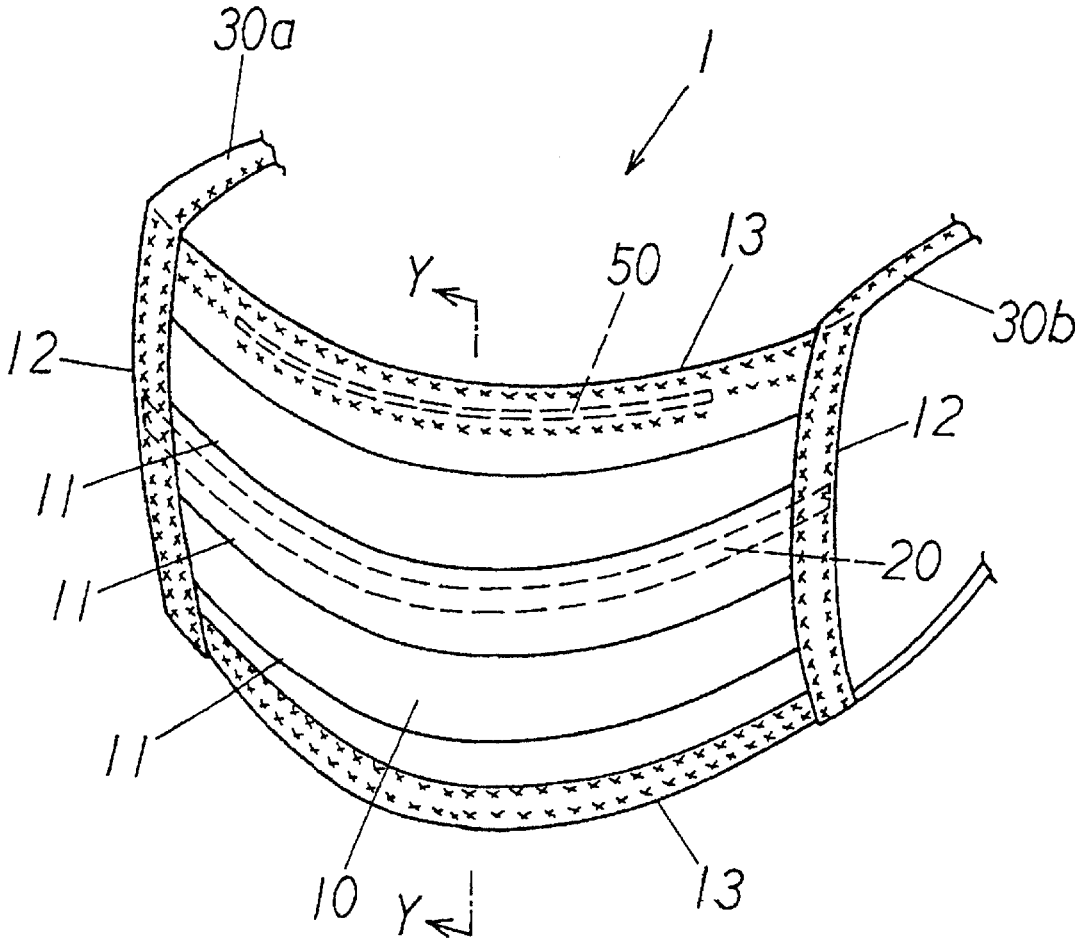
FIG. 10 is a schematic perspective view of the mask of FIG. 4 in the state of the use.

In this embodiment, the both end portions of the folded portions 11 are bound by welding (such as welding by supersonic waves). In FIGS. 6, 10, the portions welded by supersonic waves are marked with x.

In the case of welding, the mask main body 10 comprises a ventilating material, such as paper, fabric, and non-woven fabric, with thermal welding materials such as polypropylene, polyester, polyethylene, and nylon, but a material not thermally weldable can be partially included. In the case a material not thermally weldable is included, it can be used in the state interposed between thermally weldable materials. That is, it can be used by laminating in the order of a thermally weldable material, a not thermally weldable material, and a thermally weldable material.

Figure 7:
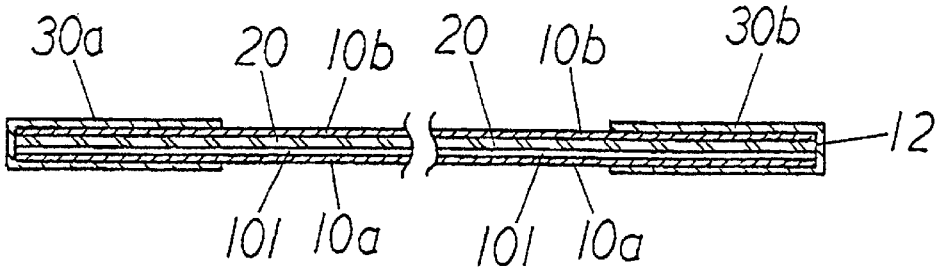
FIG. 7 is a schematic cross-sectional view taken on the line 7—7 of FIG. 4.
Figure 8:
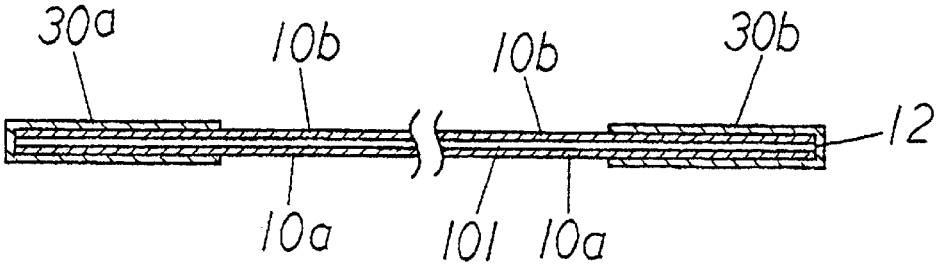
FIG. 8 is a schematic cross-sectional view taken on the line 8—8 of FIG. 4.

The rectangular mask main body 10 facing at least the nose and the mouth, comprises a rectangular rear side member 10*b* of a ventilating material, such as paper, fabric, and non-woven fabric with a filter function, and a front side member 10*a* of a ventilating material, such as paper, fabric, and non-woven fabric with a filter function, arranged on the opposite side of the rear side member 10*b*. In the embodiment, as shown in FIGS. 7, 8, a rectangular middle member 101 of a ventilating material, such as paper, fabric, and non-woven fabric, is interposed between the front side member 10*a* and the rear side member 10*b*.

Examples of a material of the middle member 101 include thermally weldable materials such as polypropylene, polyester, polyethylene and nylon.

A longitudinal elastic member, such as the plastic thin plate 20 is stored inside the mask main body 10, with the longitudinal direction of the longitudinal elastic member 20 being arranged parallel to the longer sides 13 of the rectangular mask main body 10 and the both end portions of the longitudinal elastic member 20 being connected with the mask main body 10.

That is, the both end portions of the longitudinal elastic member 20 are arranged at the both shorter sides of the mask main body 10 and integrated therewith by welding, adhering or stitching. (Although only one longitudinal elastic member 20 is shown in the drawing, two or more pieces can be provided optionally.)

Figure 5:
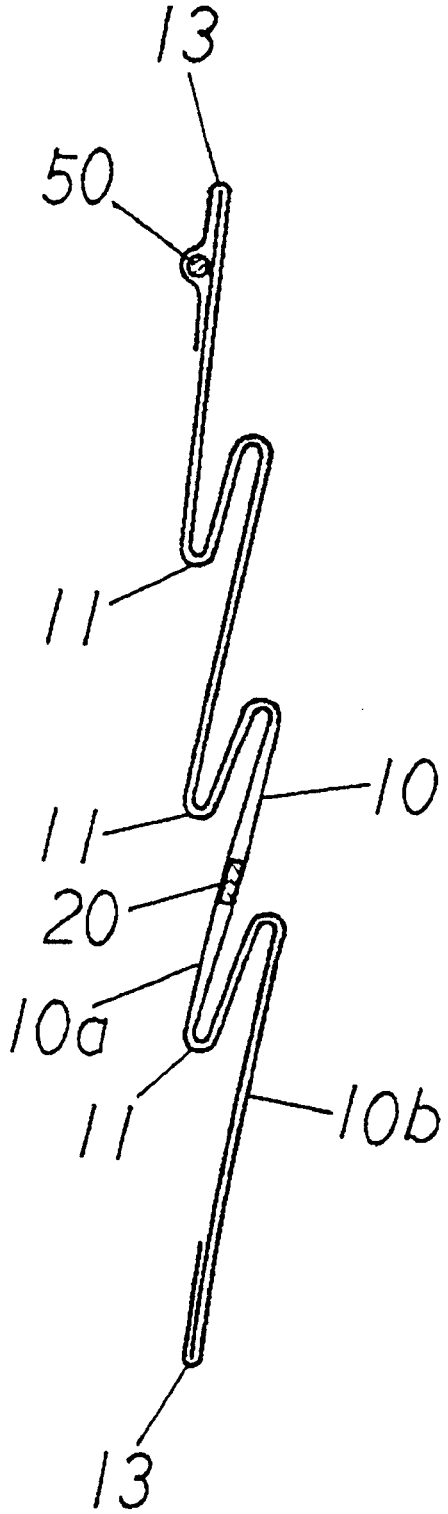
FIG. 5 is a schematic cross-sectional view taken on the line 5—5 of FIG. 4.
Figure 9:
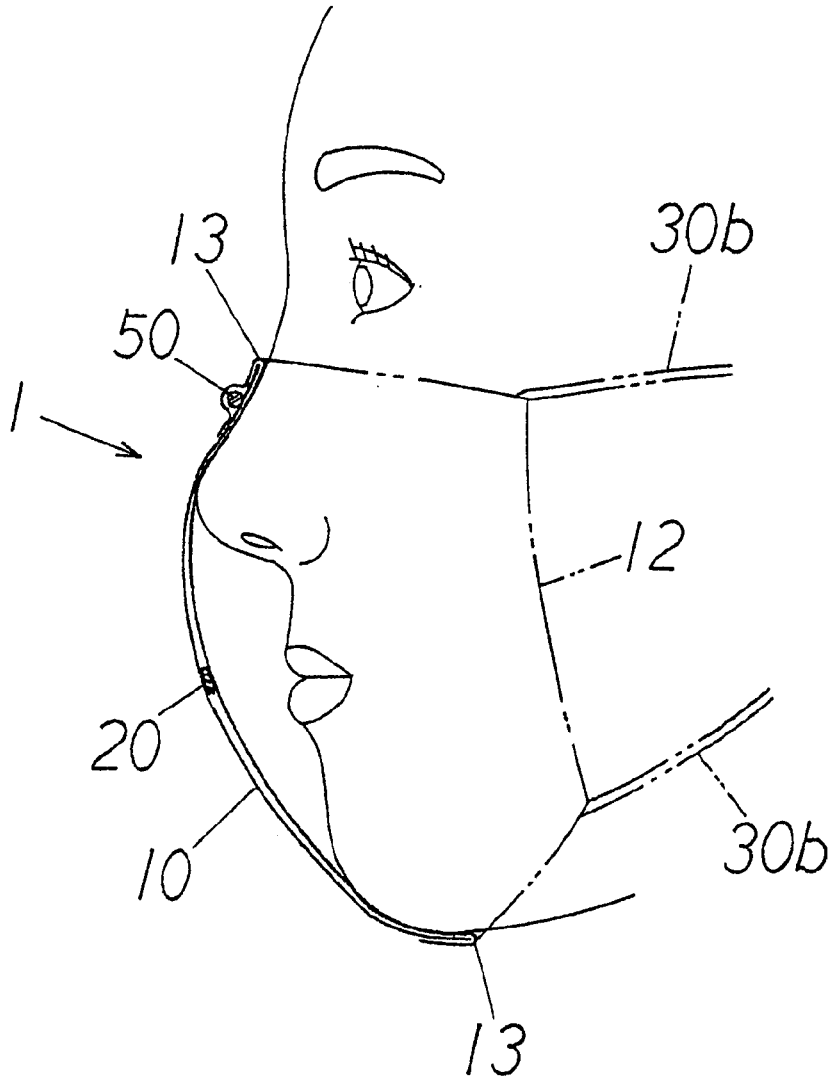
FIG. 9 is a schematic cross-sectional view of the mask of FIG. 4 being used.
Figure 11:
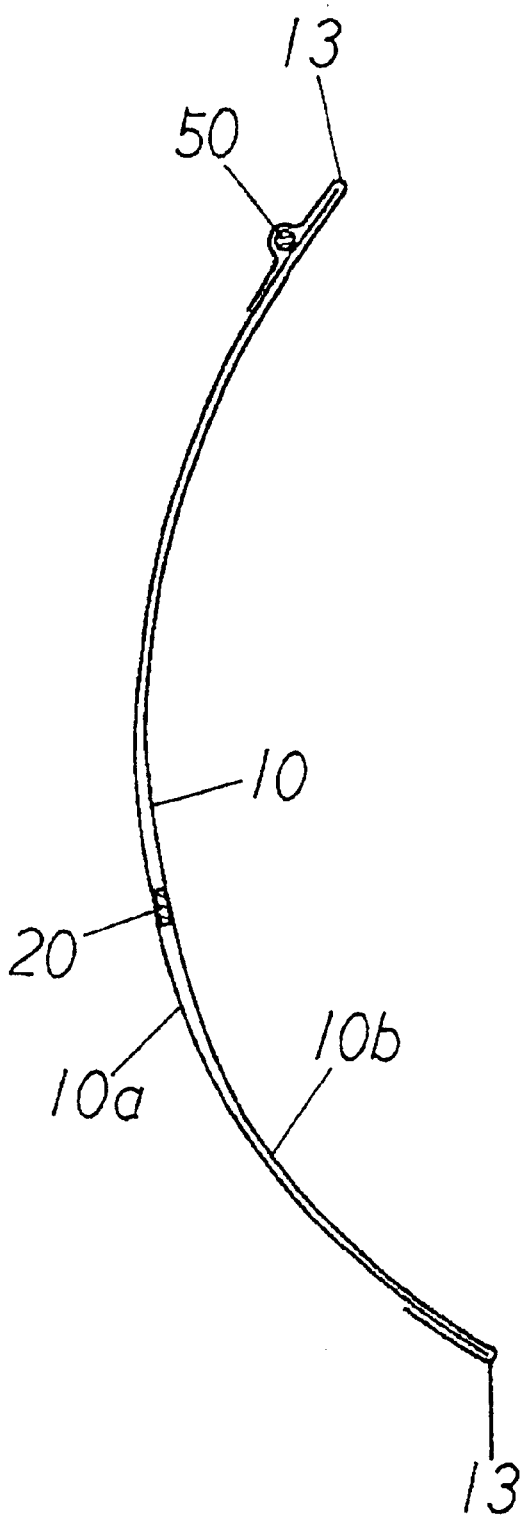
FIG. 11 is a schematic cross-sectional view taken on the line 10—10 of FIG. 10.

Accordingly, the mask 1 has the both end portions of the folded portions 11 bound by welding, adhering, or stitching but the other parts of the folded portions 11 are not bound. Also the both end portions of the longitudinal elastic member 20 are connected to the mask main body 10 along the longitudinal direction of the elastic member 20 arranged parallel to the longer sides 13 of the mask main body 10. Thus, by expanding the folded portions 11 at the time of wearing the mask 1 on the face, both the elastic member 20 and the mask main body 10 deform to have a substantially convex shape (substantially cup-like shape) with the substantially center portion of the mask main body 10 protruding as shown in FIGS. 9, 11, which is maintained owing to the existence of the elastic member 20. Since the rear side of the substantially convex-shaped mask main body 10 becomes a substantially concave shape on the user's face, the mask 1 hardly comes in direct contact with the mouth so that the handiness or stiffness of the mask is improved. Besides, since the mask 1 has the configuration of expanding the folded portions 11 as shown in FIGS. 9, 10, and 11, from the substantially flat-shaped mask 1 as shown in FIGS. 4, 5, at the time of putting on the face, the mask 1 can be packed in a compact form in the substantially flat shape at the time of shipping from the manufacturing plant.

The connection of the both end portions of the longitudinal elastic member 20 and the mask main body 10 will be described. The both end portions 20*a*, 20*b* of the elastic member are arranged at the both shorter ends of the rectangular rear side member 10*b* and the rectangular front side member 10*a*, respectively. And the movement of the both end portions 20*a*, 20*b* at the elastic member 20 are prevented by heat welding of the both shorter sides of the rear side member 10*b* and the front side member 10*a*.

More specifically, as shown in FIGS. 7 and 10, a first longitudinal curved band-like member 30*a* comprising a heat weldable material such as polypropylene, polyester, polyethylene and nylon holds one shorter side of the rectangular rear side member 10*b* and one shorter side of the rectangular front side member 10*a*. The first band-like member 30*a*, one shorter side of the rectangular rear side member 10*b*, and one shorter side of the rectangular front side member 10*a* are heat welded so as to prevent the movement of one end of the elastic member 20. Further, a second longitudinal curved band-like member 30*b* comprising a heat weldable material such as polypropylene, polyester, polyethylene and nylon holds the other shorter side of the rectangular rear side member 10*b* and the other shorter side of the rectangular front side member 10*a*. The second band-like member 30*b*, the other shorter side of the rectangular rear side member 10*b*, and the other shorter side of the rectangular front side member 10*a* are heat welded so as to prevent the movement of the other end of the elastic member 20.

Accordingly, since the first band-like member 30*a*, the second band-like member 30*b*, and the mask main body 10 are integrated by heat welding the first band-like member 30*a*, the rear side member 10*b*, and the front side member 10*a* so as to prevent the movement of one end of the elastic member 20 and heat welding the second band-like member 30*b*, the rear side member 10*b*, and the front side member 10*a* so as to prevent the movement of the other end of the elastic member 20, the first band-like member 30*a*, the second band-like member 30*b* and the elastic member 20 can be attached to the mask main body 10 more easily.

Although one shorter side of the rectangular rear side member 10*b* and one shorter side of the rectangular front side member 10*a* are held by the first band-like member 30*a*, and the other shorter side of the rectangular rear side member 10*b* and the other shorter side of the rectangular front side member are held by the second band-like member 30*b* in this embodiment, the movement of the both end portions 20*a*, 20*b* of the elastic member can be prevented by heat welding the both shorter sides of the rear side member 10*b* and the front side member 10*a* without using the first band-like member 30*a* and the second band-like member 30*b*.

In the case the air-flow resistance of the rectangular rear side member 10*b* is smaller than the air-flow resistance of the rectangular middle member 101 of the mask 1 in use, the rectangular middle member 101 tends to move toward the mouth. However, owing to the longitudinal elastic member 20, the movement is prevented. And since the air-flow resistance of the longitudinal rear side member 10*b* is smaller than the air-flow resistance of the rectangular middle member 101, the rear side member 10*b* does not tend to follow the breath and thus the movement of the rear side member 10*b* toward the mouth can be prevented.

In the case the rear side member 10*b* comprises a material with a fine texture, the rear side member 10*b* of the mask 1 in use tends to move toward the mouth due to the user's breath. However, by attaching the rear side member 10*b* directly to the elastic member 20 by adhesion, the movement of the rear side member 10*b* is prevented by the elastic member 20 so that the rear side member 10*b* of the mask 1 hardly comes in direct contact wit the mouth.

The numeral 50 denotes a prastically deformable longitudinal member for allowing the mask 1 to closely contact with the face, such as a wire.

Figure 12:
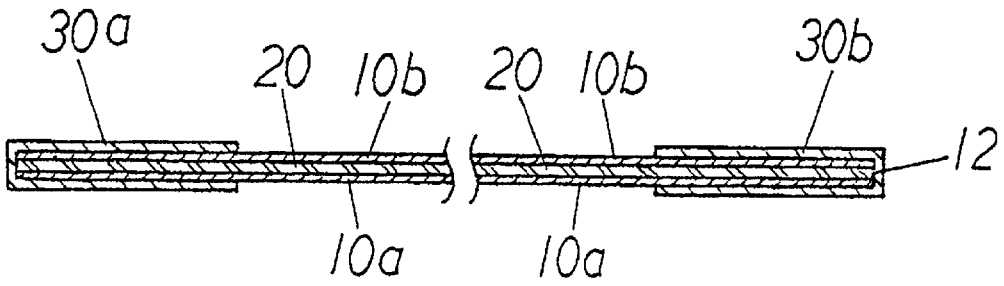
FIG. 12 is a schematic cross-sectional view of another embodiment with a configuration different from that of FIG. 7 of the mask of the present invention.
Figure 13:
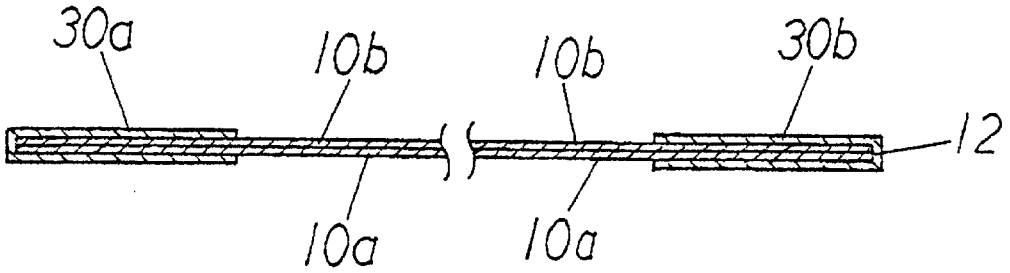
FIG. 13 is a schematic cross-sectional view of another embodiment with a configuration different from that of FIG. 8 of the mask of the present invention.

Although the middle member 101 is provided between the front side member 10*a* and the rear side member 10*b* in the above-mentioned embodiment, the mask main body 10 can consist of the front side member 10*a* and the rear side member 10*b* without the middle member 101 as shown in FIGS. 12, 13.

Figure 14:
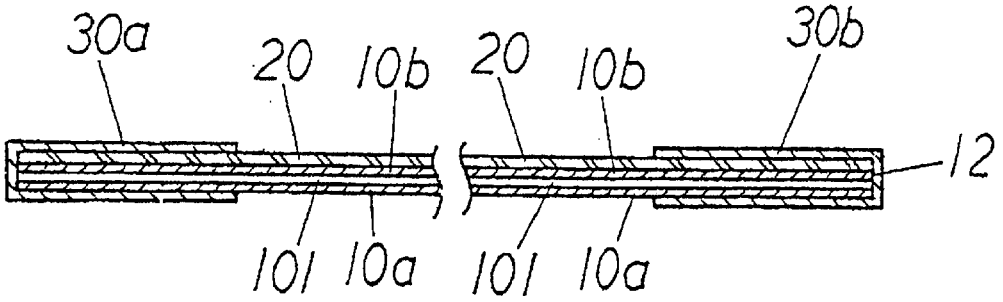
FIG. 14 is a schematic cross-sectional view of another embodiment with a configuration different from that of FIG. 13 of the mask of the present invention.

Although the longitudinal elastic member 20 is stored in the rectangular mask main body 10 in the above-mentioned embodiment, the longitudinal elastic member 20 can be arranged on the rear side of the mask main body 10 as shown in FIG. 14.

Since the both end portions of the folded portions are bound by welding, adhering or stitching but the other parts of the folded portions are not bound, and a longitudinal elastic member is provided along the longitudinal direction parallel to the longer sides of the mask main body, with the both end portions of the longitudinal elastic member being arranged on the shorter sides of the mask main body and integrated with the shorter ends of the mask main body by welding, adhering, or stitching in the mask according to the first aspect, by expanding the folded portions at the time of wearing the mask on the face, both the elastic member and the mask main body deform to have a substantially convex shape with the substantially center portion of the mask main body protruding, which is maintained owing to the existence of the elastic member. Since the rear side of the substantially convex-shaped mask main body becomes a substantially concave shape to receive the user's face, the mask hardly comes in direct contact with the mouth so that the handiness of the mask is improved. Besides, since the mask has the configuration of expanding the folded portions of the substantially flat-shaped mask at the time of putting on the face, the mask can be packed in a compact form in the substantially flat shape at the time of shipping from the manufacturing plant.

Since the mask according to the second aspect comprises the longitudinal elastic member arranged on the rear side of the mask main body, in addition to the effect of the mask of the first aspect, the movement of the rear side of the mask main body toward the mouth by the user's breath can be prevented.

Since the longitudinal elastic member is stored in the rectangular mask main body in the mask according to the third aspect, in addition to the effect of the mask of the first aspect, the rectangular mask main body comprising a ventilating material, such as paper, fabric, and non-woven fabric comes in contact with the face but the longitudinal elastic member does not come in direct contact with the face, so that the handiness of the mask can be improved.

Since the longitudinal elastic member is arranged between the rectangular middle member and the rectangular rear side member in the mask according to the fourth aspect, in addition to the effect of the mask of the first aspect, the rectangular rear side member comprising a ventilating material, such as paper, fabric, and non-woven fabric comes in contact with the face but the longitudinal elastic member does not come in direct contact with the face, so that the handiness of the mask can be improved.

Besides, since the air-flow resistance of the rectangular rear side member is smaller than the air-flow resistance of the rectangular middle member, the rectangular middle member 101 tends to move toward the mouth. However, owing to the longitudinal elastic member, the movement is prevented. And since the air-flow resistance of the longitudinal rear side member is smaller than the air-flow resistance of the rectangular middle member, the rear side member does not tend to follow the breath and thus the movement of the rear side member toward the mouth can be prevented.

Since the rectangular rear side member is integrated with the longitudinal elastic member by welding, adhering, or stitching in the mask according to the fifth aspect, in addition to the effect of the mask of the first aspect, the movement of the rectangular rear side member toward the mouth following the breath can be prevented.

Since the movement of the longitudinal elastic member can be prevented at the time the both shorter sides of the rear side member and front side member are integrated by welding, adhering or stitching in the mask according to the sixth aspect, in addition to the effect of the first aspect, the elastic member can be attached to the inside of the mask main body easily.

What is claimed is:

1. A mask comprising a rectangular mask main body made of a ventilating material and having folded portions folded in a longitudinal direction parallel to longer sides of the mask main body, with both end portions of the folded portions on shorter sides of the mask main body being connected together, wherein a longitudinal elastic member is provided along the longitudinal direction parallel to the longer sides of the mask main body, both end portions of the longitudinal elastic member being arranged on the shorter sides of the mask main body and connected to the shorter sides of the mask main body.

2. The mask according to claim 1, wherein the longitudinal elastic member is arranged on a rear side of the mask main body.

3. The mask according to claim 1, wherein the rectangular mask main body comprises a rectangular rear side member of a ventilating material facing at least a nose and a mouth of a user, and a rectangular front side member of a ventilating material, arranged opposing to the rear side member, and the longitudinal elastic member is stored in the rectangular mask main body.

4. The mask according to claim 1, wherein the rectangular mask main body comprises a rectangular front side member of a ventilating material, a rectangular middle member of a ventilating material, and a rear side member of a ventilating material facing a nose and a mouth of a user, which are successively laminated from a front to a rear side, wherein the longitudinal elastic member is arranged between the rectangular middle member and the rectangular rear side member, with an air-flow resistance of the rectangular rear side member being smaller than an air-flow resistance of the middle member.

5. The mask according to claim 1, wherein the rectangular mask main body comprises a rectangular front side member of a ventilating material, a rectangular middle member of a ventilating material, and a rear side member of a ventilating material facing a nose and a mouth of a user, which are successively laminated from a front to a rear side, wherein the longitudinal elastic member is arranged between the rectangular middle member and the rectangular rear side member, with the longitudinal elastic member and the rectangular rear side member being connected together.

6. The mask according to claim 1, wherein the rectangular mask main body comprises at least a rear side member facing a nose and a mouth of a user and a front side member arranged on an opposite side of the rear side member, with the longitudinal elastic member being stored in the rectangular mask main body, wherein the rear side member and front side member are connected on a periphery with the both end portions of the longitudinal elastic member being connected to the rear side member and the front side member at a time of connecting the shorter sides of the rear side member and the front side member.

7. The mask according to claim 1, wherein the both end portions of the longitudinal elastic member are arranged at substantially center parts of the both shorter sides of the mask main body.

* * * * *